US010570562B2

(12) United States Patent
Lund et al.

(10) Patent No.: US 10,570,562 B2
(45) **Date of Patent: *Feb. 25, 2020**

(54) METHODS FOR REDUCING CONTENT OF HEXENURONIC ACIDS IN CELLULOSIC PULP

(71) Applicant: Novozymes A/S, Bagsvaerd (DK)

(72) Inventors: Henrik Lund, Bagsvaerd (DK); Klaus Skaalum Lassen, Kastrup (DK); Bjoern Lennart Pierre Alexander Cassland, Vellinge (SE); Pedro Emanuel Garcia Loureiro, Vaerlose (DK)

(73) Assignee: Novozymes A/S, Bagsvaerd (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/949,390

(22) Filed: Apr. 10, 2018

(65) Prior Publication Data

US 2018/0230649 A1 Aug. 16, 2018

Related U.S. Application Data

(62) Division of application No. 14/910,178, filed as application No. PCT/EP2014/067020 on Aug. 7, 2014, now Pat. No. 9,970,157.

(30) Foreign Application Priority Data

Aug. 9, 2013 (EP) ..... 13179933

(51) Int. Cl.

| | |
|---|---|
| ***D21C 5/00*** | (2006.01) |
| ***D21C 9/14*** | (2006.01) |
| ***D21C 9/16*** | (2006.01) |
| ***D21C 9/12*** | (2006.01) |
| ***D21C 9/00*** | (2006.01) |

(52) U.S. Cl.

CPC ..... *D21C 5/005* (2013.01); *D21C 9/005* (2013.01); *D21C 9/12* (2013.01); *D21C 9/144* (2013.01); *D21C 9/163* (2013.01)

(58) Field of Classification Search

None

See application file for complete search history.

(56) References Cited

U.S. PATENT DOCUMENTS

| | | | | |
|---|---|---|---|---|
| 5,589,354 | A | 12/1996 | Wong | |
| 6,776,876 | B1 | 8/2004 | Vuorinen et al. | |
| 9,970,157 | B2 * | 5/2018 | Lund | D21O 5/005 |

FOREIGN PATENT DOCUMENTS

| | | | | |
|---|---|---|---|---|
| WO | 95/33833 | A1 | | 12/1995 |
| WO | 97/004102 | A1 | | 2/1997 |
| WO | WO2006126983 | | * | 5/2005 |
| WO | 2006/126983 | A1 | | 11/2006 |
| WO | 2008/044988 | A1 | | 4/2008 |
| WO | 2008/134259 | A1 | | 11/2008 |
| WO | 2009/073709 | A1 | | 6/2009 |
| WO | WO2012022840 | | * | 8/2011 |
| WO | 2012/001145 | A1 | | 1/2012 |
| WO | 2012/022840 | A1 | | 2/2012 |

OTHER PUBLICATIONS

Chica et al. Curr Opin Biotechnol. Aug. 2005;16(4):378-84. (Year: 2005).*
Singh et al. Curr Protein Pept Sci. 2017, 18, 1-11 (Year: 2017).*
Accession P49053. Feb. 1, 1996 (Year: 1996).*
Accession P49053—alignment to SEQ ID No. 2. Feb. 1, 1996 (Year: 1996).*
Accession G4XQK1. Dec. 14, 2011 (Year: 2011).*
Fillat et al. Ind. Eng. Chem. Res., 2012, 51 (7), pp. 2830-2837 (Year: 2012).*
Bogren et al. Holzforschung (2009), 63(2), 226-231 (Year: 2009).*
Prutz. Arch Biochem Biophys. Sep. 15, 1998;357(2):265-73 (Year: 1998).*
Bogren et al, 2009, Holzforschung, vol. 63, No. 2, pp. 226-231.
Chica et al, 2005, Curr Opin Biotechno, vol. 16, No. 4, pp. 378-384.
Fillat et al, 2012, Eng. Chem. Res. vol. 51, No. 7, pp. 2830-2837.
Prutz et al, 1998, Arch Biochem Biophys. vol. 357, No. 2, pp. 265-273.
Sharma et al, Accession No. G4XQK1—Dec. 14, 2011.
Simons et al, Accession P49053—Feb. 1, 1996 Alignment to SEQ ID No. 2.
Singh et al, 2017, Curr Protein Pept Sci. vol. 18, pp. 1-11.

* cited by examiner

*Primary Examiner* — Christian L Fronda
(74) *Attorney, Agent, or Firm* — Adam Rucker

(57) ABSTRACT

The present invention provides an enzymatic method for reducing the content of hexenuronic acids in a chemical cellulosic pulp and/or improvement of the brightness of cellulosic pulp using haloperoxidase.

15 Claims, No Drawings

Specification includes a Sequence Listing.

METHODS FOR REDUCING CONTENT OF HEXENURONIC ACIDS IN CELLULOSIC PULP

CROSS-REFERENCE TO RELATED APPLICATIONS

This application is a divisional of U.S. application Ser. No. 14/910,178 filed on Feb. 4, 2016 which is a 35 U.S.C. 371 national application of PCT/EP2014/067020 filed Aug. 7, 2014 which claims priority or the benefit under 35 U.S.C. 119 of European application no. EP 13179933.0 filed Aug. 9, 2013, the contents of which are fully incorporated herein by reference.

REFERENCE TO A SEQUENCE LISTING

This application contains a Sequence Listing in computer readable form. The computer readable form is incorporated herein by reference.

FIELD OF THE INVENTION

This invention generally relates to enzymatic reduction of hexenuronic acids from a chemical cellulosic pulp and/or improvement of the brightness of cellulosic pulp. A second aspect relates to an enzymatic method for the improvement of the brightness of cellulosic pulp without reducing the content of hexenuronic acids in the cellulosic pulp.

BACKGROUND

Wood comprises several different components: cellulose; hemicelluloses, such as xylan; lignin and extractives. During chemical pulping for instance in a kraft, i.e. sulphate, pulp mill the xylan chain forms side groups called hexenuronic acids (HexAs) which are unsaturated sugars. The amount of HexAs varies from pulp to pulp, because different wood species contain different amounts of xylan, which can be transformed into HexAs during the cooking process. Also, cooking parameters contribute to different amounts of HexAs.

The process of kraft pulping comprises alkaline cooking and bleaching, and it begins with wood handling where wood is debarked and made into chips. The chips are screened so fine material and oversized chips are eliminated. The chips are then fed to a digester where they first are treated with steam and then with cooking liquid, while the temperature is raised to the desired cooking temperature. When desired rate of delignification is achieved, cooking is interrupted and the content in the digester is moved to a blow tank and onwards to a screener. After the pulp is screened it is washed several times and pumped to the following delignification stage, i.e. initial bleaching. The cooking chemicals are recovered in the chemical recovery plant.

The main target for chemical pulping process is delignification in order to liberate the fibres without harming them. Alkaline delignification occurring during cooking is alkaline hydrolyses of phenol ether bonds that make lignin soluble. Phenols are weak acids that dissociate in alkali environment (pH>10). The lignin will be partly demethylated by nucleophilic attack of sulfide ions on methoxyl groups in lignin. Bleaching of the obtained pulp comprises typically a number of discrete steps or stages. In the oxygen delignification, which may occur either as pre-bleaching or bleaching step, more lignin is dissolved and washed away. This is also the case in the different following bleaching stages; peroxide bleaching, ozone bleaching and chlorine dioxide bleaching. Finally the pulp is moved to the papermaking process in integrated pulp and paper mills or it is traded as market pulp after the drying machine where it is dried, cut and packed for further transportation to paper mills.

Oxygen delignification occurring in pre-bleaching or bleaching step may comprise only one stage, but usually the process is carried out in a two-stage system with or without washing between the stages. In typical one stage oxygen delignification system the unbleached pulp is washed in the filtrate from the post-oxygen washer before it is charged with NaOH or oxidized white liquor. The pulp is preheated in a low-pressured steam mixer before it is transferred by a medium consistency pump to the high-shear, medium-consistency mixer. Oxygen is added to the mixer and the oxygen delignification process begins.

The first stage after oxygen delignification may be a delignification stage using chlorine dioxide to dissolve lignin. The typical following alkaline extraction stage (EOP) stage is an alkaline extraction stage enhanced with the oxidizing agents: oxygen and peroxide.

Alkaline oxygen and peroxide bleaching stages do not affect the HexA content in pulp. Chlorine dioxide and ozone on the other hand have a great impact on the HexA content and will react with the HexA groups in the pulp. HexAs are consumed in the chlorine dioxide stage forming unchlorinated and chlorinated dicarboxylic acids. The HexAs thus consume bleaching chemicals (electrophilic bleaching agents) and also increase brightness reversion of fully bleached pulps.

Moreover, the HexAs also bind heavy metal ions and increase the problems with non-process elements (NPEs) which will lead to an increase in deposits in the bleaching stages. This is why it is in interest to remove these components from the pulp before the bleaching stages. In that case a lower chemical batch can be used in each delignification or bleaching stage and higher brightness stability can be achieved. The kappa number, that is a measure of lignin content in pulp, is also affected by HexAs. HexAs consume potassium permanganate that is one of the reactants used in the kappa number analysis. Permanganate reacts with carbon-carbon double bonds in the lignin structure but HexAs also contribute to the consumption because of its carbon-carbon double bond.

The hot acid stage (A-stage, at pH 3, temperatures of 50-90° C. and retention time of 1-3 hours), that is disclosed in U.S. Pat. No. 6,776,876 and the hot chlorine dioxide bleaching (at temperatures 60-90° C.) disclosed in WO 2008/044988 are two methods to eliminate HexAs that are used today. Both these methods leave residual HexAs in the pulp, increase the retention time in the bleaching lines, increase the costs of effluent treatment, reduce the amount of charged groups on the fibre surface and reduce the fibre strength properties. WO 2012/022840 suggests carrying out the oxygen treatment stage in the presence of at least one perbenzoic acid, in order to decrease the amount of hexenuronic acid.

An object of the present invention is to reduce or eliminate hexenuronic acids (HexA) from lignocellulosic pulps and/or improve/increase the pulp brightness. Another object is to increase the pulp brightness e.g. without reducing the content of hexenuronic acids in the pulp.

SUMMARY

In a first aspect the present invention provides a method for reducing the content of hexenuronic acids in a chemical cellulosic pulp and/or improving the brightness of cellulosic pulp, comprising contacting the cellulosic pulp with an aqueous composition comprising 1) haloperoxidase, 2) hydrogen peroxide, and 3) halide ions/ions selected from the group consisting of chloride, bromide, iodide, and thiocyanate ions and optionally with 4) one or more tertiary amines. A second aspect relates to a method for improvement of the brightness of cellulosic pulp without significantly reducing the content of hexenuronic acids in the cellulosic pulp. The second aspect can be performed without contacting the cellulosic pulp with one or more tertiary amines. Other aspects and embodiments of the invention are apparent from the description and examples.

DETAILED DESCRIPTION

Cellulosic Pulp

Cellulosic pulp can be used for the production of paper materials, such as paper, linerboard, corrugated paperboard, tissue, towels, packaging materials, corrugated containers or boxes.

Cellulosic pulp is a fibrous material prepared by chemically or mechanically separating cellulose fibres from wood, fibre crops or waste paper. For example, the pulp can be supplied as a virgin pulp, or can be derived from a recycled source. The pulp may be a wood pulp, a non-wood pulp or a pulp made from waste paper. A wood pulp may be made from softwood such as pine, redwood, fir, spruce, cedar and hemlock or from hardwood such as maple, alder, birch, hickory, beech, aspen, acacia and eucalyptus. A non-wood pulp may be made, e.g., from flax, hemp, bagasse, bamboo, cotton or kenaf. A waste paper pulp may be made by re-pulping waste paper such as newspaper, mixed office waste, computer print-out, white ledger, magazines, milk cartons, paper cups etc.

In a particular embodiment, the pulp to be treated comprises both hardwood pulp and softwood pulp.

The wood pulp to be treated is a chemical pulp (such as Kraft pulp or sulfite pulp), semi-chemical pulp (SCP), chemithermomechanical pulp (CTMP), or bleached chemithermomechanical pulp (BCTMP).

Chemical pulp is manufactured by alkaline or acidic cooking whereby most of the lignin and hemicellulose components are removed. In Kraft pulping or sulphate cooking sodium sulphide and sodium hydroxide are used as principal cooking chemicals.

The Kraft pulp to be treated may be a unbleached, partially bleached or fully bleached Kraft pulp, which may consist of softwood bleached Kraft (SWBK, also called NBKP (Nadel Holz Bleached Kraft Pulp)), hardwood bleached Kraft (HWBK, also called LBKP (Laub Holz Bleached Kraft Pulp and)) or a mixture of these. Optionally oxygen delignification can be performed.

The pulp to be used in the process of the invention is a suspension of mechanical or chemical pulp or a combination thereof. For example, the pulp to be used in the process of the invention may comprise 0%, 10-20%, 20-30%, 30-40%, 40-50%, 50-60%, 60-70%, 70-80%, 80-90%, or 90-100% of chemical pulp. In a particular embodiment, a chemical pulp forms part of the pulp being used for manufacturing the paper material. In the present context, the expression "forms part of" means that in the pulp to be used in the process of the invention, the percentage of chemical pulp lies within the range of 1-99%. In particular embodiments, the percentage of chemical pulp lies within the range of 2-98%, 3-97%, 4-96%, 5-95%, 6-94%, 7-93%, 8-92%, 9-91%, 10-90%, 15-85%, 20-80%, 25-75%, 30-70%, 40-60%, or 45-55%.

In a particular embodiment of the use and the process of the invention, the chemical pulp is a Kraft pulp, a sulfite pulp, a semichemical pulp (SCP), a thermomechanical pulp (TMP), a chemithermomechanical pulp (CTMP), a bleached chemithermomechanical pulp (BCTMP). In particular embodiments the Kraft pulp is unbleached, partially bleached or fully bleached Kraft pulp, for example softwood bleached Kraft (SWBK, also called NBKP (Nadel Holz Bleached Kraft Pulp)), hardwood bleached Kraft (HWBK, also called LBKP (Laub Holz Bleached Kraft Pulp and)) or a mixture thereof.

Haloperoxidase

The haloperoxidases suitable for being incorporated in the method of the invention include chloroperoxidases, bromoperoxidases and compounds exhibiting chloroperoxidase or bromoperoxidase activity. Haloperoxidases form a class of enzymes that are capable of oxidizing halides ($Cl^-$, $Br^-$, $I^-$) and thiocyanate ($SCN^-$) in the presence of hydrogen peroxide or a hydrogen peroxide generating system to the corresponding hypohalous acids or hypohalites; or in the case of thiocyanate, to hypothiocyanous acid or hypothiocyanite.

Haloperoxidases are classified according to their specificity for halide ions. Chloroperoxidases (E.C. 1.11.1.10) catalyze formation of hypochlorite from chloride ions, hypobromite from bromide ions and hypoiodite from iodide ions; and bromoperoxidases catalyze formation of hypobromite from bromide ions and hypoiodite from iodide ions. Hypoiodite, however, with iodide disproportionates to form elemental iodine and thus iodine is the observed product. The hypohalite compounds may subsequently react with other compounds forming halogenated compounds.

In a preferred embodiment, the haloperoxidase of the invention is a chloroperoxidase.

Haloperoxidases have been isolated from various organisms: mammals, marine animals, plants, algae, lichen, fungi and bacteria. It is generally accepted that haloperoxidases are the enzymes responsible for the formation of halogenated compounds in nature, although other enzymes may be involved.

Haloperoxidases have been isolated from many different fungi, in particular from the fungus group dematiaceous hyphomycetes, such as *Caldariomyces*, e.g., *C. fumago, Alternaria, Curvularia*, e.g., *C. verruculosa* and *C. inaequalis, Drechslera, Ulocladium* and *Botrytis*.

Haloperoxidases have also been isolated from bacteria such as *Pseudomonas*, e.g., *P. pyrrocinia* and *Streptomyces*, e.g., *S. aureofaciens*.

In a preferred embodiment, the haloperoxidase is a vanadium haloperoxidase, i.e. a vanadate-containing haloperoxidase.

In a more preferred embodiment, the haloperoxidase is derivable from *Curvularia* sp., in particular *Curvularia verruculosa* or *Curvularia inaequalis*, such as *C. inaequalis* CBS 102.42 as described in WO 95/27046, e.g. a vanadium haloperoxidase encoded by the DNA sequence of WO 95/27046, FIG. 2 all incorporated by reference; or *C. verruculosa* CBS 147.63 or *C. verruculosa* CBS 444.70 as described in WO 97/04102.

In an embodiment, the amino acid sequence of the haloperoxidase has at least 60% identity, preferably at least 65%, more preferably at least 70%, more preferably at least 75%, more preferably at least 80%, more preferably at least 85%, more preferably at least 90%, more preferably at least 95%, and most preferably 100% identity to the amino acid sequence of a haloperoxidase from *Curvularia verruculosa* (see e.g. SEQ ID NO: 2 in WO 97/04102; also shown as SEQ ID NO: 1 in the present application/sequence listing) or

*Curvularia inaequalis* (e.g. the mature amino acid sequence encoded by the DNA sequence in FIG. 2 of WO 95/27046; also shown as SEQ ID NO: 2 in the present application/sequence listing).

In an embodiment, the amino acid sequence of the haloperoxidase has one or more/several substitutions and/or one or more/several deletions and/or one or more/several insertions compared to SEQ ID NO: 1 or SEQ ID NO: 2.

The vanadium chloroperoxidase may also be derivable from *Drechslera hartlebii* as described in WO 01/79459, *Dendryphiella salina* as described in WO 01/79458, *Phaeotrichoconis crotalarie* as described in WO 01/79461, or *Geniculosporium* sp. as described in WO 01/79460.

The relatedness between two amino acid sequences is described by the parameter "sequence identity". For purposes of the present invention, the sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 5.0.0 or later. The parameters used are gap open penalty of 10, gap extension penalty of 0.5, and the EBLOSUM62 (EMBOSS version of BLOSUM62) substitution matrix. The output of Needle labeled "longest identity" (obtained using the —nobrief option) is used as the percent identity and is calculated as follows: (Identical Residues×100)/(Length of Alignment−Total Number of Gaps in Alignment).

The concentration of the haloperoxidase in the aqueous composition is typically in the range of 0.01-100 ppm enzyme protein, preferably 0.05-50 ppm enzyme protein, more preferably 0.1-50 ppm enzyme protein, more preferably 0.1-30 ppm enzyme protein, more preferably 0.5-20 ppm enzyme protein, and most preferably 0.5-10 ppm enzyme protein.

In an embodiment, the concentration of the haloperoxidase is typically in the range of 1-60 ppm enzyme protein, preferably 1-20 ppm enzyme protein, more preferably 1-10 ppm enzyme protein.

In one embodiment the haloperoxidase is immobilized to a solid or semi-solid support.

Determination of Haloperoxidase Activity

An assay for determining haloperoxidase activity may be carried out by mixing 100 μL of haloperoxidase sample (containing about 0.2 μg enzyme protein/mL) and 100 μL of a 0.3 M sodium phosphate pH 7 buffer containing 0.5 M potassium bromide and 0.008% phenol red, adding the solution to 10 μL of 0.3% $H_2O_2$, and measuring the absorption at 595 nm as a function of time.

Another assay using monochlorodimedone (Sigma M4632, $\varepsilon$=20000 $M^{-1}cm^{-1}$ at 290 nm) as a substrate may be carried out by measuring the decrease in absorption at 290 nm as a function of time. The assay is performed in an aqueous solution of 0.1 M sodium phosphate or 0.1 M sodium acetate, 50 μM monochlorodimedone, 10 mM KBr/KCl, 1 mM $H_2O_2$ and about 1 μg/mL haloperoxidase.

Hydrogen Peroxide

The hydrogen peroxide required by the haloperoxidase may be provided as an aqueous solution of hydrogen peroxide or a hydrogen peroxide precursor for in situ production of hydrogen peroxide. Any solid entity which liberates upon dissolution a peroxide, which is useable by haloperoxidase, can serve as a source of hydrogen peroxide. Compounds which yield hydrogen peroxide upon dissolution in water or an appropriate aqueous based medium include but are not limited to metal peroxides, percarbonates, persulphates, perphosphates, peroxyacids, alkyperoxides, acylperoxides, peroxyesters, urea peroxide, perborates and peroxycarboxylic acids or salts thereof.

Another source of hydrogen peroxide is a hydrogen peroxide generating enzyme system, such as an oxidase together with a substrate for the oxidase. Examples of combinations of oxidase and substrate comprise, but are not limited to, amino acid oxidase (see e.g. U.S. Pat. No. 6,248,575) and a suitable amino acid, glucose oxidase (see e.g. WO 95/29996) and glucose, lactate oxidase and lactate, galactose oxidase (see e.g. WO 00/50606) and galactose, and aldose oxidase (see e.g. WO 99/31990) and a suitable aldose.

By studying EC 1.1.3._, EC 1.2.3._, EC 1.4.3._, and EC 1.5.3._ or similar classes (under the International Union of Biochemistry), other examples of such combinations of oxidases and substrates are easily recognized by one skilled in the art.

Alternative oxidants which may be applied for haloperoxidases may be oxygen combined with a suitable hydrogen donor like ascorbic acid, dehydroascorbic acid, dihydroxyfumaric acid or cysteine. An example of such oxygen hydrogen donor system is described by Pasta et al., Biotechnology & Bioengineering, (1999) vol. 62, issue 4, pp. 489-493.

Hydrogen peroxide or a source of hydrogen peroxide may be added at the beginning of or during the method of the invention, e.g. as one or more separate additions of hydrogen peroxide; or continuously as fed-batch addition. Typical amounts of hydrogen peroxide correspond to levels of from 0.001 mM to 25 mM, preferably to levels of from 0.005 mM to 5 mM, and particularly to levels of from 0.01 to 1 mM or 0.02 to 2 mM hydrogen peroxide. Hydrogen peroxide may also be used in an amount corresponding to levels of from 0.1 mM to 25 mM, preferably to levels of from 0.5 mM to 15 mM, more preferably to levels of from 1 mM to 10 mM, and most preferably to levels of from 2 mM to 8 mM hydrogen peroxide.

Chloride, Bromide, Iodide and/or Thiocyanate Ions

Chloride ions ($Cl^-$), bromide ions ($Br^-$), iodide ions ($I^-$), and/or thiocyanate ions ($SCN^-$) for reaction with the haloperoxidase may be provided in many different ways, such as by adding chloride salt(s), bromide salt(s), iodide salt(s), and/or thiocyanate salts to an aqueous solution. Preferably, chloride ions are used for reaction with the haloperoxidase.

In a preferred embodiment, the chloride salt(s) are sodium chloride (NaCl), potassium chloride (KCl), ammonium chloride ($NH_4Cl$) or magnesium chloride ($MgCl_2$), or mixtures thereof.

In another preferred embodiment, bromide salt(s) are sodium bromide (NaBr), potassium bromide (KBr), or magnesium bromide ($MgBr_2$), or mixtures thereof.

In another preferred embodiment, the iodide salt(s) are sodium iodide (NaI), potassium iodide (KI), or magnesium iodide ($MgI_2$), or mixtures thereof In another preferred embodiment, thiocyanate salt(s) are sodium thiocyanate (NaSCN), potassium thiocyanate (KSCN), or magnesium thiocyanate ($Mg(SCN)_2$), or mixtures thereof.

The concentration of chloride ions, bromide ions, iodide ions, and/or thiocyanate ions in the aqueous composition according to the invention can collectively or individually be in the range of from 0.01 mM to 1000 mM, preferably in the range of from 0.05 mM to 500 mM, more preferably in the range of from 0.1 mM to 100 mM, most preferably in the range of from 0.1 mM to 50 mM, and in particular in the range of from 1 mM to 25 mM.

In one embodiment the chloride ions are not $NH_4Cl$.

Tertiary Amine

In a preferred embodiment one or more tertiary amines are included in the method according to the invention or in the aqueous composition according to the invention. The addition of one or more tertiary amines can further boost/increase the brightness compared to the method of the invention where one or more tertiary amines are not included in the method or the aqueous composition of the invention. The addition of one or more tertiary amines can further boost/increase the HexA removal compared to the method of the invention where one or more tertiary amines are not included in the method or the aqueous composition of the invention. Furthermore the addition of one or more tertiary amines can further boost/increase the brightness and further boost/increase the HexA removal compared to the method of the invention where one or more tertiary amines are not included in the method or the aqueous composition of the invention.

A tertiary amine is a compound derived from ammonia by replacing the three hydrogen atoms by substituents (R) having the general structure R3N. Any tertiary amine capable of catalyzing the reaction of hypochlorous acid (HOCl) or other reactive species generated in the HAP-stage with HexA and pulp chromophores is suitable to the present invention. This type of catalytic effect of several tertiary amines in the reaction of HOCl with different substrates was described by Prütz in *Archives of Biochemistry and Biophysics*, vol. 357, no. 2, September 15, pp. 265-273, 1998.

The one or more tertiary amines can be organic and/or inorganic tertiary amines. The one or more tertiary amines can be cyclic and/or non-cyclic tertiary amines.

The tertiary amine is preferably 1,4-Diazabicyclo[2.2.2]octane (DABCO; also known as triethylenediamine) with CAS number 280-57-9 supplied by Sigma-Aldrich (product number: D27802).

The one or more tertiary amines can be a bicyclic tertiary amine such as Quinuclidine. The one or more tertiary amine can also be morpholine buffer MES, the piperazine buffers Hepes, TMN, DMNA, Pipes, 1-[Bis[3-(dimethylamino)propyl]amino]-2-propanol, 1,6-Diaminohexane-N,N,N',N'-tetraacetic acid, 2-[2-(Dimethylamino)ethoxy]ethanol, N,N,N',N",N"-Pentamethyldiethylenetriamine, N,N,N',N'-Tetraethyl-1,3-propanediamine, N,N,N',N'-Tetramethyl-1,4-butanediamine, N,N,N',N'-Tetramethyl-2-butene-1,4-diamine, N,N,N',N'-Tetramethyl-1,6-hexanediamine, 1,4,8,11-Tetramethyl-1,4,8,11-tetraazacyclotetradecane, 1,3,5-Trimethylhexahydro-1,3,5-triazine, and/or Trimethylolpropane tris (2-methyl-1-aziridinepropionate). In one embodiment suitable tertiary amines can be one or more selected from the group consisting of trimethylamine, triethylamine, N,N-dimethylcyclohexylamine, N,N-diethylcyclohexylamine, N,N-dimethylaniline, N,N-diethyl aniline, pyridine, picoline, methylpyridine, quinoline or salts thereof. Examples of the tertiary amines that are useful include the N-alkyl morpholines in which the alkyl substituent has from 1 to 18 carbon atoms of which N-methyl morpholine is typical, triethylamine, triethanolamine, dimethylethanolamine, N,N diethylcyclohexylamine, and 1,4 diazobicylol 2 2 2 loctane. The tertiary amines can further be selected from the group consisting of di- and polyamines, alkoxylated di- and polyamines, 3-alkyloxypropylamines, alkoxylated 3-alkyloxypropylamines, N-(3-alkoxypropyl)-1,3-propanediamines, alkoxylated N-(3-alkoxypropyl)-1,3-propanediamines, amidoamines and amino acids. In another embodiment the tertiary amines can be selected from the group consisting of Methylene diamine; substituted imidazoles such as 1-2 dimethylimidazole, 1-methyl-2-hydroxyethylimidazole; N,N' dimethylpiperazine or substituted piperazines such as aminoethylpiperazine or bis(N-methyl piperazine)ethylurea or N,N',N'trimethyl aminoethylpiperazine; N-methylpyrrolidines and substituted methyl pyrrolidines such as 2-aminoethyl-N, methylpyrrolidines or Bis(N-methylpyrrolidine)ethyl urea; or other tertiary aminoalkylureas or bis(tertiary amino alkyl) urea such as N,N-(3-dimethylaminopropyl)urea; 3-dimethylaminopropylamine; N,N,N"N"tetramethyldipropylenetriamine; N,N-bis(3-dimethylaminopropyl) 1-3propanediamine; N,N-dimethylamino-N",N'bis(hydroxyl-(2)-propylpropylene(1,3)diamine; tetramethylguanidine; Dimethylaminopropylamine, 1,2 bis-diisopropanol(3-dimethylaminopropylamine), substituted piperidines and aminotriazines such N,N dimethylaminopropyl-S-triazine; N-alkylmorpholines such as N-methylmorpholine, N-ethylmorpholine, N-butylmorpholine, and dimorpholinodiethylether; N, Ndimethylaminoethanol; $N_5$N-dimethylaminoethoxyethanol; Bis(dimethylaminopropyl)-amino-2-propanol; Bis(dimethylamino)-2-propanol; Bis(N,N-dimethylamino)ethylether; N,N,N'Trimethyl-N'hydroxyethyl-Bis-(aminoethyl)ether; $N_5$N dimethylaminoethyl-N'-methyl aminoethanol; tetramethyliminobispropylamine, and mixtures thereof.

Xylanase

A xylanase, as may optionally be used in the present invention, is an enzyme classified as EC 3.2.1.8. The official name is endo-1,4-beta-xylanase. The systematic name is 1,4-beta-D-xylan xylanohydrolase. Other names may be used, such as endo-(1-4)-beta-xylanase; (1-4)-beta-xylan 4-xylanohydrolase; endo-1,4-xylanase; xylanase; beta-1,4-xylanase; endo-1,4-xylanase; endo-beta-1,4-xylanase; endo-1,4-beta-D-xylanase; 1,4-beta-xylan xylanohydrolase; beta-xylanase; beta-1,4-xylan xylanohydrolase; endo-1,4-beta-xylanase; beta-D-xylanase. The reaction catalysed is the endohydrolysis of 1,4-beta-D-xylosidic linkages in xylans.

According to CAZy(ModO), xylanases are presently classified in either of the following Glycoside Hydrolyase Families: 10, 11, 43, 5, or 8.

In an embodiment, the xylanase is derived from a bacterial xylanase, e.g. a *Bacillus* xylanase, for example from a strain of *Bacillus halodurans, Bacillus pumilus, Bacillus agaradhaerens, Bacillus circulans, Bacillus polymyxa, Bacillus* sp., *Bacillus stearothermophilus*, or *Bacillus subtilis*, including each of the *Bacillus* xylanase sequences entered at the CAZy(ModO) site.

In a further particular embodiment the family 11 glycoside hydrolase is a fungal xylanase. Fungal xylanases include yeast and filamentous fungal polypeptides as defined above, with the proviso that these polypeptides have xylanase activity.

Examples of fungal xylanases of family 11 glycoside hydrolase are those which can be derived from the following fungal genera: *Aspergillus, Aureobasidium, Emericella, Fusarium, Gaeumannomyces, Humicola, Lentinula, Magnaporthe, Neocallimastix, Nocardiopsis, Orpinomyces, Paecilomyces, Penicillium, Pichia, Schizophyllum, Talaromyces, Thermomyces, Trichoderma.*

Examples of species of these genera are listed below in the general polypeptide section. The sequences of xylanase polypeptides deriving from a number of these organisms have been submitted to the databases GenBank/GenPept and SwissProt with accession numbers which are apparent from the CAZy(ModO) site.

A preferred fungal xylanase of family 11 glycoside hydrolases is a xylanase derived from (i) *Aspergillus*, such as SwissProt P48824, SwissProt P33557, SwissProt P55329, SwissProt P55330, SwissProt Q12557, SwissProt Q12550, SwissProt Q12549, SwissProt P55328, SwissProt Q12534, SwissProt P87037, SwissProt P55331, SwissProt Q12568, GenPept BAB20794.1, GenPept CAB69366.1;

(ii) *Trichoderma*, such as SwissProt P48793, SwissProt P36218, SwissProt P36217, GenPept AAG01167.1, GenPept CAB60757.1;

(iii) *Thermomyces* or *Humicola*, such as SwissProt Q43097; or (iv) a xylanase having an amino acid sequence of at least 75% identity to a (mature) amino acid sequence of any of the xylanases of (i)-(iii); or (v) a xylanase encoded by a nucleic acid sequence which hybridizes under low stringency conditions with a mature xylanase encoding part of a gene corresponding to any of the xylanases of (i)-(iii);

(vi) a variant of any of the xylanases of (i)-(iii) comprising a substitution, deletion, and/or insertion of one or more amino acids;

(vii) an allelic variant of (i)-(iv);

(viii) a fragment of (i), (ii), (iii), (iv) or (vi) that has xylanase activity; or (ix) a synthetic polypeptide designed on the basis of (i)-(iii) and having xylanase activity.

A preferred xylanase is the *Thermomyces* xylanase described in WO 96/23062.

Various *Aspergillus* xylanases are also described in EP 695349, EP 600865, EP 628080, and EP 532533. EP 579672 describes a *Humicola* xylanase.

Preferably, the amino acid sequence of the xylanase has at least 60% identity, preferably at least 65% identity, more preferably at least 70% identity, more preferably at least 75% identity, more preferably at least 80% identity, more preferably at least 85% identity, more preferably at least 90% identity, even more preferably at least 95% identity, and most preferably at least 97% identity to the amino acid sequence of a *Bacillus agaradhaerens* xylanase (SEQ ID NO: 3).

In an embodiment, the amino acid sequence of the xylanase has one or several substitutions, deletions or insertions compared to SEQ ID NO: 3. In particular, the amino acid sequence of the xylanase is identical to SEQ ID NO: 3.

Determination of Xylanase Activity

Xylanase activity can be measured using any assay, in which a substrate is employed, that includes 1,4-beta-D-xylosidic endo-linkages in xylans. Assay-pH and assay-temperature are to be adapted to the xylanase in question.

Different types of substrates are available for the determination of xylanase activity e.g. Xylazyme cross-linked arabinoxylan tablets (from MegaZyme), or insoluble powder dispersions and solutions of azo-dyed arabinoxylan.

Hexenuronic Acid (HexA)

The Kappa number is an indication of the residual lignin content or bleachability of pulp by a standardized analysis method. The Kappa number is determined by ISO 302, which is applicable to all kinds of chemical and semi-chemical pulps and gives a Kappa number in the range of 1-100. The measurement is inflated by the presence of hexenuronic acids in the pulp.

Hexenuronic acids are unsaturated sugars formed by base catalyzed elimination of methanol from 4-O-methyl-D-glucuronoxylans from the hemicelluloses, during the chemical pulping process.

In the context of the present invention, measurement of HexA in pulp can be based on a procedure described in Vuorinen et al., "Selective hydrolysis of hexenuronic acid groups and its application in ECF and TCF bleaching of kraft pulps", *Journal of Pulp and Paper Science,* 1999, 25 (5), pp. 155-162; where the HexA content in pulp is selectively hydrolysed and converted to furan derivatives that are quantified in the hydrolyzate by UV spectroscopy (as shown in Example 1).

The Kappa number is an indication of the residual lignin content or bleachability of pulp by a standardized analysis method. The Kappa number is determined by ISO 302, which is applicable to all kinds of chemical and semi-chemical pulps and gives a Kappa number in the range of 1-100. The measurement is inflated by the presence of hexenuronic acids in the pulp.

Determination of Brightness and Intrinsic Viscosity

Handsheets for brightness measurements can be prepared according to TAPPI T205 standard procedure using Formax semi-automated sheet former and pressed with e.g. a Labtech automatic sheet press. The brightness values of the handsheets can be determined using e.g. a Macbeth Color-Eye 7000 Remissions spectrophotometer, measuring e.g. 3 times on each side of the handsheet at 460 nm. As for the "ISO brightness" (diffuse blue reflectance factor) measurement, handsheets can be prepared according to ISO 3688 using e.g. a Büchner funnel and pressed with e.g. a Labtech automatic sheet press. The measurements can e.g. be done using a Color Touch PC spectrophotometer from Technidyne.

The intrinsic viscosity of the pulp can be measured according to ISO 5351.

Methods and Uses

In a first aspect the present invention provides a method for reducing the content of hexenuronic acids in a chemical cellulosic pulp and/or improving chemical cellulosic pulp brightness, comprising contacting the cellulosic pulp with a haloperoxidase, hydrogen peroxide, and halide ions/ions selected from the group consisting of chloride, bromide, iodide, and thiocyanate ions and optionally with one or more tertiary amines. The haloperoxidase, hydrogen peroxide, and halide ions/ions selected from the group consisting of chloride, bromide, iodide, and thiocyanate ions and optionally the one or more tertiary amines can be in an aqueous composition. In one embodiment the halide ion is not $NH_4Cl$ and the cellulosic pulp is not contacted with tertiary amines.

In a second aspect the present invention provides a method for improvement of chemical cellulosic pulp brightness without significant reduction of the content of hexenuronic acids in a chemical cellulosic pulp, comprising contacting the cellulosic pulp with a haloperoxidase, hydrogen peroxide, and $NH_4Cl$ without contacting the cellulosic pulp with one or more tertiary amines.

In an embodiment the haloperoxidase is a chloroperoxidase from enzyme class EC 1.11.1.10. Preferably, the haloperoxidase is a vanadium haloperoxidase; more preferably, the amino acid sequence of the haloperoxidase has at least 80% identity, preferably at least 85% identity, more preferably at least 90% identity, even more preferably at least 95% identity, and most preferably at least 97% identity to the amino acid sequence of a *Curvularia verruculosa* haloperoxidase (SEQ ID NO: 1) or a *Curvularia inaequalis* haloperoxidase (SEQ ID NO: 2).

In an embodiment the chemical cellulosic pulp/aqueous composition is also contacted with a xylanase either before, after or simultaneously with performing the method of the invention. Preferably, the xylanase is an endo-1,4-beta-xylanase from enzyme class EC 3.2.1.8. Preferably, the amino acid sequence of the xylanase has at least 60% identity, preferably at least 65% identity, more preferably at least 70% identity, more preferably at least 75% identity, more preferably at least 80% identity, more preferably at least 85% identity, more preferably at least 90% identity, even more preferably at least 95% identity, and most preferably at least 97% identity to the amino acid sequence of a *Bacillus agaradhaerens* xylanase (SEQ ID NO: 3). In a preferred embodiment, the amino acid sequence of the haloperoxidase is shown as SEQ ID NO: 1 and the amino acid sequence of the xylanase is shown as SEQ ID NO: 3.

In an embodiment the chemical cellulosic pulp is made by alkaline cooking. The chemical cellulosic pulp can be a kraft pulp.

In an embodiment, the method of the invention includes a subsequent alkaline extraction stage (E-stage). Preferably, the alkaline extraction stage is reinforced with hydrogen peroxide and/or oxygen, designated E or $E_P$ or $E_{OP}$ stages, respectively. Most preferably, it includes other bleaching chemicals combined with the extraction, as chlorine dioxide stages (D-stages), ozone (Z-stages) and hydrogen peroxide (P-stages).

In another aspect, the invention provides an aqueous composition comprising a haloperoxidase; chloride, bromide, iodide, or thiocyanate ions; hydrogen peroxide and a chemical cellulosic pulp comprising hexenuronic acids and optionally one or more tertiary amines.

In an embodiment the haloperoxidase is a chloroperoxidase from enzyme class EC 1.11.1.10. Preferably, the haloperoxidase is a vanadium haloperoxidase; more preferably, the amino acid sequence of the haloperoxidase has at least 80% identity, preferably at least 85% identity, more preferably at least 90% identity, even more preferably at least 95% identity, and most preferably at least 97% identity to the amino acid sequence of a *Curvularia verruculosa* haloperoxidase (SEQ ID NO: 1) or a *Curvularia inaequalis* haloperoxidase (SEQ ID NO: 2).

In an embodiment the chemical cellulosic pulp also includes a xylanase. Preferably, the xylanase is an endo-1, 4-beta-xylanase from enzyme class EC 3.2.1.8. Preferably, the amino acid sequence of the xylanase has at least 60% identity, preferably at least 65% identity, more preferably at least 70% identity, more preferably at least 75% identity, more preferably at least 80% identity, more preferably at least 85% identity, more preferably at least 90% identity, even more preferably at least 95% identity, and most preferably at least 97% identity to the amino acid sequence of a *Bacillus agaradhaerens* xylanase (SEQ ID NO: 3). In a preferred embodiment, the amino acid sequence of the haloperoxidase is shown as SEQ ID NO: 1 and the amino acid sequence of the xylanase is shown as SEQ ID NO: 3.

In an embodiment the chemical cellulosic pulp is a kraft pulp.

The invention also provides for use of the methods and compositions above for reducing the content of hexenuronic acids in chemical cellulosic pulp.

The methods according to the invention may be carried out at a temperature between 20 and 90 degrees Celsius, preferably between 20 and 80 degrees Celsius, more preferably between 20 and 70 degrees Celsius, even more preferably between 30 and 70 degrees Celsius, most preferably between 30 and 60 degrees Celsius, and in particular between 30 and 50 degrees Celsius.

The methods of the invention may employ a treatment time of from 1 minute to 120 minutes, preferably from 1 minute to 90 minutes, more preferably from 10 minutes to 90 minutes, most preferably from 10 minutes to 60 minutes, and in particular from 10 minutes to 30 minutes. In another embodiment the methods of the invention of may employ a treatment time of from 5 minutes to 4 hours, such as from 5 minutes to 15 minutes, for example from 15 minutes to 30 minutes, such as from 30 minutes to 1 hour, for example from 1 hour to 2 hours, such as from 2 hour to 3 hours or for example from 3 hour to 4 hours, or any combination of these intervals.

The methods of the invention may be carried out at pH 2 to pH 11, preferably at pH 3 to pH 10, more preferably at pH 3 to pH 9. Most preferably, the methods of the invention are carried out at the pH or temperature optimum of the haloperoxidase system +/−one pH unit.

In one embodiment the intrinsic viscosity of the pulp is maintained after the HAP-stage, which indicates no effect on pulp degradation.

The present invention of is further described in the set of items herein below.

1. A method for reducing the content of hexenuronic acids in a chemical cellulosic pulp and/or improving the brightness of a chemical cellulosic pulp, comprising contacting the cellulosic pulp with a haloperoxidase, hydrogen peroxide, and ions selected from the group consisting of chloride, bromide, iodide, and thiocyanate ions and optionally with one or more tertiary amines.
2. The method of item 1, wherein the haloperoxidase is a chloroperoxidase from enzyme class EC 1.11.1.10.
3. The method of item 1 or 2, wherein the haloperoxidase is a vanadium haloperoxidase.
4. The method of any of items 1 to 3, wherein the amino acid sequence of the haloperoxidase has at least 80% identity, preferably at least 85% identity, more preferably at least 90% identity, even more preferably at least 95% identity, and most preferably at least 97% identity to the amino acid sequence of a *Curvularia verruculosa* haloperoxidase (SEQ ID NO: 1) or a *Curvularia inaequalis* haloperoxidase (SEQ ID NO: 2).
5. The method of any of items 1 to 4, wherein the chemical cellulosic pulp is also contacted with a xylanase; preferably an endo-1,4-beta-xylanase from enzyme class EC 3.2.1.8.
6. The method of item 5, wherein the amino acid sequence of the xylanase has at least 60% identity, preferably at least 65% identity, more preferably at least 70% identity, more preferably at least 75% identity, more preferably at least 80% identity, more preferably at least 85% identity, more preferably at least 90% identity, even more preferably at least 95% identity, and most preferably at least 97% identity to the amino acid sequence of a *Bacillus agaradhaerens* xylanase (SEQ ID NO: 3).
7. The method of item 5 or 6, wherein the amino acid sequence of the haloperoxidase is shown as SEQ ID NO: 1 and the amino acid sequence of the xylanase is shown as SEQ ID NO: 3.
8. The method of any of items 1 to 7, wherein the chemical cellulosic pulp is a pulp made by alkaline cooking such as a kraft pulp, or a sulfite pulp or any other pulp that needs bleaching.
9. The method of any of items 1 to 8, which includes a subsequent alkaline extraction stage.
10. The method of item 9, wherein the alkaline extraction stage is reinforced with hydrogen peroxide and/or oxygen with or without a previous bleaching agent as for example chlorine dioxide.
11. An aqueous composition comprising a haloperoxidase; chloride, bromide, iodide, or thiocyanate ions; and a chemical cellulosic pulp comprising hexenuronic acids and optionally one or more tertiary amines.

12. The composition of item 11, wherein the chemical cellulosic pulp is a pulp made by alkaline cooking such as a kraft pulp.

13. The composition of item 11 or 12, which also includes a xylanase.

14. Use of a haloperoxidase for reducing the content of hexenuronic acids in a chemical cellulosic pulp and/or for improving the brightness of a chemical cellulosic pulp.

15. The use according to claim 14, which include use of a xylanase.

The present invention is further described by the following examples which should not be construed as limiting the scope of the invention.

EXAMPLES

Chemicals used as buffers and substrates were commercial products of at least reagent grade. The haloperoxidase (HAP) used in the examples has an amino acid sequence shown as SEQ ID NO: 1. The xylanase used in the examples has an amino acid sequence shown as SEQ ID NO: 3.

The handsheets for brightness measurements were prepared according to TAPPI T205 standard procedure using Formax semi-automated sheet former and pressed with a Labtech automatic sheet press. The brightness values of the handsheets were determined using a Macbeth Color-Eye 7000 Remissions spectrophotometer, measuring 3 times on each side of the handsheet at 460 nm. Five handsheets were used per sample resulting in a total of 30 measurements per sample. As for the "ISO brightness" (diffuse blue reflectance factor) measurement, handsheets were prepared according to ISO 3688 using a Büchner funnel and pressed with a Labtech automatic sheet press. The measurements were done using the Color Touch PC spectrophotometer from Technidyne.

The intrinsic viscosity of the pulp was measured according to ISO 5351.

Example 1

Measurement of HexA Content in Paper Pulp

The measurement of HexA in pulp was based on a procedure described in Vuorinen et al., "Selective hydrolysis of hexenuronic acid groups and its application in ECF and TCF bleaching of kraft pulps", *Journal of Pulp and Paper Science,* 1999, 25 (5), pp. 155-162; where the HexA content in pulp is selectively hydrolysed and converted to furan derivatives that are quantified in the hydrolyzate by UV spectroscopy.

Typically, 2.0-2.5 g odp (oven-dry pulp) are weighted and mixed with 150 mL of formate buffer (0.01 M; pH 3.5) in a 200 mL steel beaker which is introduced in the Labomat BFA-24.

The Labomat BFA-24 (Werner Mathis AG, Switzerland) is an instrument which allows controlling temperature, mechanical agitation and treatment time of the reaction systems in the beakers. The instrument is controlled by the Univision S software (Univision S "BFA" Programming Instruction, version 2.0 edition 07/2006 by Werner Mathis AG, Switzerland).

Beaker temperature is increased by heat transfer from an infrared-radiation unit. Beakers are cooled down by cooling the air in a heat exchanger with a cooling water supply. The Labomat can be operated by loading a predefined program which defines temperature profiles, agitation and time.

The pre-defined program for the measurement of HexA in the pulp samples had the following parameters: hydrolysis time of 60 min; Hydrolysis temperature of 110 min and rotating speed of 5 rpm with 30 s clockwise alternating with 30 s anticlockwise.

After the pre-defined hydrolysis time (60 min), the hot vessels were cooled in an ice-bath. Once cooled, it was mixed with a rod and a sample of pulp slurry was withdrawn from each vessel and then filtered using a 10 mL lur-loc syringe coupled to a 0.45 mm filter. The collected filtrate/hydrolysate was analyzed by UV spectroscopy and the absorbance at 245 and 285 nm was measured which corresponds to the absorption maxima of 2-furoic acid and 5-carboxy-2-furaldehyde, respectively (Vuorinen et al. 1996).

The content of HexA in pulp was calculated according to the following formula:

$$HexA(\text{mmol/kg odp}) = \frac{AV}{\varepsilon l w}$$

w—weight of oven-dry pulp sample (kg);

V=0.15 L;

A—absorbance at 245 nm (2-furoic acid) with background correction at 480 nm;

$\varepsilon$=8700 $M^{-1}cm^{-1}$—molar absorption coefficient of 2-furoic acid at 245 nm with respect to HexA in hexenuronoxylo-oligosacharides;

l—cell path length.

Example 2

Dosage of Haloperoxidase

Oxygen delignified eucalypt kraft pulp (typically 10 g of oven-dry fiber; kappa number 10) with an amount of HexAs of ca. 55 mmol/kg odp was used in the enzymatic treatments with haloperoxidase. The pulp was treated with haloperoxidase at 10% consistency, at a temperature of 45° C., pH 4.5 (acetate buffer) and for 60 min. The initial concentration of hydrogen peroxide and sodium chloride (NaCl) were 0.6, 1.2, 2.0, 4.0 and 6.0 mM while using 6, 12, 20, 40 and 60 mg EP/kg odp of haloperoxidase, respectively. The pulp suspension was incubated in polyethylene sealed plastic bags immersed in a temperature controlled water bath.

After incubation, the pulp was washed and filtrated with 2 L of warm tap water divided in two steps and 1 L of deionized water.

In Table 1 it is shown that there is increased HexA removal up to approx. 27% for increased dosage of enzyme which is translated in a decrease of kappa number.

TABLE 1

| Haloperoxidase concentration (mg EP/kg odp) | HexA content (mmol/kg odp) | Kappa number |
|---|---|---|
| untreated | 55 | 10 |
| 6 | 54.5 | 9.1 |
| 12 | 52.2 | 8.9 |
| 20 | 44.3 | 8.3 |
| 40 | 41.6 | 7.8 |
| 60 | 40.0 | — |

Example 3

Effect of a Xylanase Stage Before the Haloperoxidase Stage

Similarly to Example 2, the same oxygen delignified eucalypt kraft pulp was used. This pulp was submitted to a xylanase treatment (X-stage) at pH 8 (Britton-Robinson Buffer), 55° C. for 120 min (10% consistency). After the X-stage, the pulp was washed as described previously and further treated with haloperoxidase under the same conditions of temperature, pH and incubation time as studied in Example 2, but using different chloride salts (NaCl and $MgCl_2$). The initial salt concentration was 6 mM (as with $H_2O_2$), and 60 mg haloperoxidase EP/kg odp was used in the HAP-stage, and 6 mg xylanase EP/kg odp was used in the X-stage.

The results presented in Table 2 refer only to the haloperoxidase treated that did not have a prior xylanase treatment, but that were treated under the same conditions as in the X-stage (buffer at pH 8, 55° C. for 120 min and without xylanase).

It is seen that the addition of $MgCl_2$ leads to a comparable degree of HexA removal as with NaCl. The use of $NH_4Cl$ gave a modest reduction in HexA content but it is observed a decrease in kappa number which indicates degradation of other oxidizable structures in pulp such as lignin structures.

TABLE 2

| Salt | HexA content (mmol/kg odp) | Kappa number |
|---|---|---|
| untreated | 55 | 10 |
| NaCl | 42.1 | 7.6 |
| $MgCl_2$ | 41.1 | 7.1 |
| $NH_4Cl$ | 50.1 | 8.0 |

In Table 3 is presented the results of the pulps that were both treated with xylanase (X-stage) followed by haloperoxidase treatment (X-HAP). There is an increased HexA removal when the X-stage precedes the haloperoxidase treatment (up to 41% HexA removal).

TABLE 3

| Salt | HexA content (mmol/kg odp) | Kappa number |
|---|---|---|
| untreated | 55 | 10 |
| NaCl | 34.2 | 6.5 |
| $MgCl_2$ | 32.4 | 5.8 |
| $NH_4Cl$ | 40.8 | 6.9 |

Example 4

Effect of Temperature and Incubation Time

Similarly to Example 2, the same oxygen delignified eucalypt kraft pulp was used in the enzymatic treatments with haloperoxidase under the same pH. The temperature of 60° C. and the incubation time of 120 min were studied with NaCl. The initial salt concentration was of 0.6 and 6 mM (as with $H_2O_2$) for a low and high dosage of enzyme, respectively.

The results of HexA removal are shown in Table 4. The amount of HexA removed is improved by extending the incubation time to 120 min (compare to Table 1).

TABLE 4

| Experiment | Enzyme dosage (mg EP/kg odp) | HexA content (mmol/kg odp) |
|---|---|---|
| 60° C., 60 min, NaCl | 6 | 51.5 |
| 60° C., 60 min, NaCl | 60 | 46.9 |
| 45° C., 120 min, NaCl | 60 | 38.0 |

Example 5

Effect of Haloperoxidase (HAP) in Brightness Gain and Bleachability

Similar to Example 2, the same oxygen delignified eucalypt kraft pulp was used in the enzymatic treatments with haloperoxidase, under the same conditions of temperature and pH. The dosage of enzyme was 60 mg EP/kg odp for 120 min of incubation time. NaCl or $NH_4Cl$ was added at an initial concentration of 6 mM, the same as with $H_2O_2$.

The HAP-treated pulp was then bleached either with an alkaline extraction stage reinforced with hydrogen peroxide (Ep), or with chlorine dioxide stage (D) followed by the Ep-stage. A control sample was used without addition of enzyme (only with buffer).

The results shown in Table 6 indicate that the haloperoxidase treatment (HAP-stage) also produces a brightness gain. In spite of the $NH_4Cl$-system has removed less HexA under the studied conditions (Example 3), it removes more visible chromophores than the NaCl-system as indicated by the higher brightness gain obtained. This can be explained by the different reactivity of the co-generated chloramines when using $NH_4Cl$ in comparison with hypochlorous acid (HOCl) reactivity.

The performance of the HAP-stage on a post-alkaline extraction stage reinforced with hydrogen peroxide (Ep-stage) was studied. The conditions of the Ep-stage were: 0.5% odp $H_2O_2$, 1.0% odp NaOH, at 85° C., for 80 min and using 10% consistency in sealed polyethylene bags in a water bath. Higher brightness values are attained compared to control (up to more 4.7 units) when HAP-stage is used. The effect of HexA removal when using the NaCl-system is observed in the lowest kappa number obtained. On the other hand, with the use of $NH_4Cl$ it is possible to reach higher brightness with low HexA removal.

The use of a chlorine dioxide stage (D) followed by the Ep-stage after the haloperoxidase was also studied. The conditions of the D-stage were 0.8% odp $ClO_2$, pH 3.5, at 80° C., for 110 min and using 10% consistency in sealed polyethylene bags in a water bath. While there is lower kappa number when using the HAP stage before D-Ep bleaching, particularly when NaCl-system is used, the brightness attained is slightly inferior to the control. This may indicate that the HAP-treated pulp may need a lower dosage of $ClO_2$ for the same target brightness, and thus the values in Table 6 are at a plateau level.

TABLE 6

| | Brightness | HAP-Ep | | HAP-D-Ep | |
|---|---|---|---|---|---|
| Experiment | after HAP (%) | Brightness (%) | Kappa number | Brightness (%) | Kappa number |
| Control | 63.2 | 72.1 | 7.9 | 88.0 | 2.8 |
| NaCl | 67.3 | 76.5 | 6.3 | 87.8 | 1.7 |
| $NH_4Cl$ | 67.9 | 76.8 | 7.3 | 87.6 | 2.4 |

Example 6

Effect of Reducing the Dosage of $ClO_2$ in the D-stage of the HAP-D-Ep Sequence The same haloperoxidase treated pulps of Example 5 were bleached with D-Ep bleaching stages using the same operating conditions except for different dosages of chlorine dioxide.

The results presented in Table 7 show that there is a decrease in the brightness attained after D-Ep bleaching (control without HAP-stage) while reducing the dosage of chlorine dioxide. However, the same is not observed after HAP-D-Ep bleaching as the final brightness remains nearly at the same value. However, if the chlorine dioxide dosage is adjusted (reduced) the HAP-stage allows savings in chlorine dioxide for a same brightness target. Although it reduces the brightness ceiling obtainable after D-Ep bleaching, with the HAP treatment less chlorine dioxide charge will be needed for a same brightness target. When no-stage is introduced (either HAP or control) the brightness and kappa number that is attained is nearly the same as with HAP-D-Ep with 50% reduction of $ClO_2$.

As for the kappa number, it decreases in both sequences along with the decrease of chlorine dioxide dosage. Lower kappa numbers are attained when using a prior HAP stage due to the previous reduction in the content of HexA.

TABLE 7

| | | HAP-D-Ep | |
|---|---|---|---|
| Experiment | $ClO_2$ dosage (% odp) | Brightness (%) | Kappa number |
| No pre-treatment | 1.15 | 88.0 | 2.8 |
| Control | 0.80 (~−30%) | 88.5 | 2.8 |
| HAP (NaCl) | | 87.8 | 1.7 |
| Control | 0.57 (~−50%) | 86.9 | 3.7 |
| HAP (NaCl) | | 87.7 | 2.7 |

Example 7

The Impact of the HAP-Stage Using a Partially Bleached Aspen Kraft Pulp: HexA Content and ISO Brightness Aspen kraft pulp previously bleached with chlorine dioxide ($D_0$) and alkaline extraction ($E_1$) having ISO brightness of 76.8% with an amount of HexAs of ca. 26 mmol/kg odp was treated with haloperoxidase under the same procedure and conditions of pH, temperature, time and consistency as in Example 2. The dosage of enzyme was 60 mg EP/kg odp and NaCl or $NH_4Cl$ was added at an initial concentration of 6 mM, the same as with $H_2O_2$. Control experiments were run in parallel where only buffer, salt and hydrogen peroxide were added to the pulp (no enzyme).

It is observed in Table 8 that the HAP stage decreases the HexA content by 28% compared to the untreated sample when the NaCl is used. When the $NH_4Cl$ is added, under the conditions studied, the amount of HexAs is not decreased. Both HAP stages with either NaCl or $NH_4Cl$ improve the brightness of the pulp, being slightly greater with the addition of $NH_4Cl$.

TABLE 8

| Experiment | HexA content (mmol/kg odp) | ISO brightness (%) |
|---|---|---|
| untreated | 26.3 | 76.8 |
| Control NaCl (no enzyme) | 24.8 | 76.1 |
| HAP (NaCl) | 18.9 | 79.5 |
| Control $NH_4Cl$ (no enzyme) | 26.8 | 77.7 |
| HAP ($NH_4Cl$) | 26.1 | 79.8 |

Example 8

The Effect of Using a Tertiary Amine in the HAP-stage

Similarly to Example 7, the same aspen kraft pulp was used and treated under the same operating conditions, except for the addition of 1,4-Diazabicyclo[2.2.2]octane (DABCO). The dosage of enzyme was 60 mg EP/kg odp and NaCl or $NH_4Cl$ was added at an initial concentration of 6 mM, the same as with $H_2O_2$ and DABCO. Control experiments were run in parallel where only buffer, salt, DABCO and hydrogen peroxide were added to the pulp (no enzyme).

In Table 9 it is seen that the addition of DABCO in the HAP-stage improved the extent of HexA removal using both salts compared to Example 7 where DABCO was not added. In fact, using $NH_4Cl$ it is reached the highest removal of HexA by ca. 54% of the HexA content in the original untreated sample. While without DABCO addition in the HAP stage using the $NH_4Cl$ salt there is almost no HexA removed, when DABCO is added there is a significant boost in HexA removal as well as in brightness gain. The addition of the tertiary amine in the HAP-stage had a catalytic effect on both HexA removal and removal of visible chromophores (brightness gain).

TABLE 9

| Experiment | HexA content (mmol/kg odp) | ISO brightness (%) |
|---|---|---|
| Untreated pulp | 26.3 | 76.8 |
| Control NaCl, DABCO (no enzyme) | 27.8 | 77.3 |
| HAP (NaCl, DABCO) | 15.3 | 79.8 |
| Control $NH_4Cl$, DABCO (no enzyme) | 27.9 | 77.4 |
| HAP ($NH_4Cl$, DABCO) | 12.1 | 80.4 |

Example 9

The Impact of the HAP-Stage Using a Northern Bleached Softwood Kraft Pulp: ISO Brightness and Intrinsic Viscosity A fully bleached softwood pulp (pine and hemlock mixture) was treated with haloperoxidase under the same procedure and conditions of pH, temperature, time and consistency as in Example 2. The dosage of enzyme was 60 mg EP/kg odp and NaCl or $NH_4Cl$ was added at an initial concentration of 6 mM, the same as with $H_2O_2$.

The results of the ISO brightness and intrinsic viscosity are shown in Table 9. It is observed a gain in the ISO brightness of 1.8-2.0 units with all the salts studied compared with the control experiments where no enzyme added. In addition, the intrinsic viscosity of the pulp is maintained after the HAP-stage, which indicates no effect on pulp degradation.

TABLE 10

| Experiment | ISO brightness (%) | Intrinsic viscosity ($dm^3$/kg) |
|---|---|---|
| Control NaCl (no enzyme) | 84.8 | 829 |
| HAP (NaCl) | 86.6 | 825 |
| Control $MgCl_2$ (no enzyme) | 84.8 | 820 |
| HAP ($MgCl_2$) | 86.8 | 827 |
| Control $NH_4Cl$ (no enzyme) | 84.6 | 832 |
| HAP ($NH_4Cl$) | 86.4 | 825 |

SEQUENCE LISTING

<160> NUMBER OF SEQ ID NOS: 3

<210> SEQ ID NO 1
<211> LENGTH: 600
<212> TYPE: PRT
<213> ORGANISM: Curvularia verruculosa

<400> SEQUENCE: 1

Met Gly Ser Val Thr Pro Ile Pro Leu Pro Thr Ile Asp Glu Pro Glu
1 5 10 15

Glu Tyr Asn Asn Asn Tyr Ile Leu Phe Trp Asn Asn Val Gly Leu Glu
20 25 30

Leu Asn Arg Leu Thr His Thr Val Gly Gly Pro Leu Thr Gly Pro Pro
35 40 45

Leu Ser Ala Arg Ala Leu Gly Met Leu His Leu Ala Ile His Asp Ala
50 55 60

Tyr Phe Ser Ile Cys Pro Pro Thr Glu Phe Thr Thr Phe Leu Ser Pro
65 70 75 80

Asp Ala Glu Asn Pro Ala Tyr Arg Leu Pro Ser Pro Asn Gly Ala Asp
85 90 95

Asp Ala Arg Gln Ala Val Ala Gly Ala Ala Leu Lys Met Leu Ser Ser
100 105 110

Leu Tyr Met Lys Pro Ala Asp Pro Asn Thr Gly Thr Asn Ile Ser Asp
115 120 125

Asn Ala Tyr Ala Gln Leu Ala Leu Val Leu Glu Arg Ala Val Val Lys
130 135 140

Val Pro Gly Gly Val Asp Arg Glu Ser Val Ser Phe Met Phe Gly Glu
145 150 155 160

Ala Val Ala Asp Val Phe Phe Ala Leu Leu Asn Asp Pro Arg Gly Ala
165 170 175

Ser Gln Glu Gly Tyr Gln Pro Thr Pro Gly Arg Tyr Lys Phe Asp Asp
180 185 190

Glu Pro Thr His Pro Val Val Leu Val Pro Val Asp Pro Asn Asn Pro
195 200 205

Asn Gly Pro Lys Met Pro Phe Arg Gln Tyr His Ala Pro Phe Tyr Gly
210 215 220

Met Thr Thr Lys Arg Phe Ala Thr Gln Ser Glu His Ile Leu Ala Asp
225 230 235 240

Pro Pro Gly Leu Arg Ser Asn Ala Asp Glu Thr Ala Glu Tyr Asp Asp
245 250 255

Ser Ile Arg Val Ala Ile Ala Met Gly Gly Ala Gln Asp Leu Asn Ser
260 265 270

Thr Lys Arg Ser Pro Trp Gln Thr Ala Gln Gly Leu Tyr Trp Ala Tyr
275 280 285

Asp Gly Ser Asn Leu Val Gly Thr Pro Pro Arg Phe Tyr Asn Gln Ile
290 295 300

Val Arg Arg Ile Ala Val Thr Tyr Lys Lys Glu Asp Asp Leu Ala Asn
305 310 315 320

Ser Glu Val Asn Asn Ala Asp Phe Ala Arg Leu Phe Ala Leu Val Asn
325 330 335

Val Ala Cys Thr Asp Ala Gly Ile Phe Ser Trp Lys Glu Lys Trp Glu
340 345 350

Phe Glu Phe Trp Arg Pro Leu Ser Gly Val Arg Asp Asp Gly Arg Pro
355 360 365

```
Asp His Gly Asp Pro Phe Trp Leu Thr Leu Gly Ala Pro Ala Thr Asn
    370                 375                 380

Thr Asn Asp Ile Pro Phe Lys Pro Pro Phe Pro Ala Tyr Pro Ser Gly
385                 390                 395                 400

His Ala Thr Phe Gly Gly Ala Val Phe Gln Met Val Arg Arg Tyr Tyr
                405                 410                 415

Asn Gly Arg Val Gly Thr Trp Lys Asp Asp Glu Pro Asp Asn Ile Ala
            420                 425                 430

Ile Asp Met Met Ile Ser Glu Glu Leu Asn Gly Val Asn Arg Asp Leu
        435                 440                 445

Arg Gln Pro Tyr Asp Pro Thr Ala Pro Ile Glu Asp Gln Pro Gly Ile
    450                 455                 460

Val Arg Thr Arg Ile Val Arg His Phe Asp Ser Ala Trp Glu Met Met
465                 470                 475                 480

Phe Glu Asn Ala Ile Ser Arg Ile Phe Leu Gly Val His Trp Arg Phe
                485                 490                 495

Asp Ala Ala Ala Ala Arg Asp Ile Leu Ile Pro Thr Asn Thr Lys Asp
            500                 505                 510

Val Tyr Ala Val Asp Ser Asn Gly Ala Thr Val Phe Gln Asn Val Glu
        515                 520                 525

Asp Val Arg Tyr Ser Thr Lys Gly Thr Arg Glu Gly Arg Glu Gly Leu
    530                 535                 540

Phe Pro Ile Gly Gly Val Pro Leu Gly Ile Glu Ile Ala Asp Glu Ile
545                 550                 555                 560

Phe Asn Asn Gly Leu Arg Pro Thr Pro Pro Glu Leu Gln Pro Met Pro
                565                 570                 575

Gln Asp Thr Pro Val Gln Lys Pro Val Gln Gly Met Trp Asp Glu Gln
            580                 585                 590

Val Pro Leu Val Lys Glu Ala Pro
        595                 600


<210> SEQ ID NO 2
<211> LENGTH: 609
<212> TYPE: PRT
<213> ORGANISM: Curvularia inaequalis

<400> SEQUENCE: 2

Met Gly Ser Val Thr Pro Ile Pro Leu Pro Lys Ile Asp Glu Pro Glu
1               5                   10                  15

Glu Tyr Asn Thr Asn Tyr Ile Leu Phe Trp Asn His Val Gly Leu Glu
            20                  25                  30

Leu Asn Arg Val Thr His Thr Val Gly Gly Pro Leu Thr Gly Pro Pro
        35                  40                  45

Leu Ser Ala Arg Ala Leu Gly Met Leu His Leu Ala Ile His Asp Ala
    50                  55                  60

Tyr Phe Ser Ile Cys Pro Pro Thr Asp Phe Thr Thr Phe Leu Ser Pro
65                  70                  75                  80

Asp Thr Glu Asn Ala Ala Tyr Arg Leu Pro Ser Pro Asn Gly Ala Asn
                85                  90                  95

Asp Ala Arg Gln Ala Val Ala Gly Ala Ala Leu Lys Met Leu Ser Ser
            100                 105                 110

Leu Tyr Met Lys Pro Val Glu Gln Pro Asn Pro Asn Pro Gly Ala Asn
        115                 120                 125

Ile Ser Asp Asn Ala Tyr Ala Gln Leu Gly Leu Val Leu Asp Arg Ser
    130                 135                 140
```

```
Val Leu Glu Ala Pro Gly Gly Val Asp Arg Glu Ser Ala Ser Phe Met
145                 150                 155                 160

Phe Gly Glu Asp Val Ala Asp Val Phe Phe Ala Leu Leu Asn Asp Pro
                165                 170                 175

Arg Gly Ala Ser Gln Glu Gly Tyr His Pro Thr Pro Gly Arg Tyr Lys
            180                 185                 190

Phe Asp Asp Glu Pro Thr His Pro Val Val Leu Ile Pro Val Asp Pro
        195                 200                 205

Asn Asn Pro Asn Gly Pro Lys Met Pro Phe Arg Gln Tyr His Ala Pro
    210                 215                 220

Phe Tyr Gly Lys Thr Thr Lys Arg Phe Ala Thr Gln Ser Glu His Phe
225                 230                 235                 240

Leu Ala Asp Pro Pro Gly Leu Arg Ser Asn Ala Asp Glu Thr Ala Glu
                245                 250                 255

Tyr Asp Asp Ala Val Arg Val Ala Ile Ala Met Gly Gly Ala Gln Ala
            260                 265                 270

Leu Asn Ser Thr Lys Arg Ser Pro Trp Gln Thr Ala Gln Gly Leu Tyr
        275                 280                 285

Trp Ala Tyr Asp Gly Ser Asn Leu Ile Gly Thr Pro Pro Arg Phe Tyr
    290                 295                 300

Asn Gln Ile Val Arg Arg Ile Ala Val Thr Tyr Lys Lys Glu Glu Asp
305                 310                 315                 320

Leu Ala Asn Ser Glu Val Asn Asn Ala Asp Phe Ala Arg Leu Phe Ala
                325                 330                 335

Leu Val Asp Val Ala Cys Thr Asp Ala Gly Ile Phe Ser Trp Lys Glu
            340                 345                 350

Lys Trp Glu Phe Glu Phe Trp Arg Pro Leu Ser Gly Val Arg Asp Asp
        355                 360                 365

Gly Arg Pro Asp His Gly Asp Pro Phe Trp Leu Thr Leu Gly Ala Pro
    370                 375                 380

Ala Thr Asn Thr Asn Asp Ile Pro Phe Lys Pro Pro Phe Pro Ala Tyr
385                 390                 395                 400

Pro Ser Gly His Ala Thr Phe Gly Gly Ala Val Phe Gln Met Val Arg
                405                 410                 415

Arg Tyr Tyr Asn Gly Arg Val Gly Thr Trp Lys Asp Asp Glu Pro Asp
            420                 425                 430

Asn Ile Ala Ile Asp Met Met Ile Ser Glu Glu Leu Asn Gly Val Asn
        435                 440                 445

Arg Asp Leu Arg Gln Pro Tyr Asp Pro Thr Ala Pro Ile Glu Asp Gln
    450                 455                 460

Pro Gly Ile Val Arg Thr Arg Ile Val Arg His Phe Asp Ser Ala Trp
465                 470                 475                 480

Glu Leu Met Phe Glu Asn Ala Ile Ser Arg Ile Phe Leu Gly Val His
                485                 490                 495

Trp Arg Phe Asp Ala Ala Ala Ala Arg Asp Ile Leu Ile Pro Thr Thr
            500                 505                 510

Thr Lys Asp Val Tyr Ala Val Asp Asn Asn Gly Ala Thr Val Phe Gln
        515                 520                 525

Asn Val Glu Asp Ile Arg Tyr Thr Thr Arg Gly Thr Arg Glu Asp Pro
    530                 535                 540

Glu Gly Leu Phe Pro Ile Gly Gly Val Pro Leu Gly Ile Glu Ile Ala
545                 550                 555                 560
```

-continued

```
Asp Glu Ile Phe Asn Asn Gly Leu Lys Pro Thr Pro Pro Glu Ile Gln
                565                 570                 575

Pro Met Pro Gln Glu Thr Pro Val Gln Lys Pro Val Gly Gln Gln Pro
            580                 585                 590

Val Lys Gly Met Trp Glu Glu Glu Gln Ala Pro Val Val Lys Glu Ala
        595                 600                 605

Pro


<210> SEQ ID NO 3
<211> LENGTH: 221
<212> TYPE: PRT
<213> ORGANISM: Bacillus agaradhaerens

<400> SEQUENCE: 3

Gln Ile Val Thr Asp Asn Ser Ile Gly Asn His Asp Gly Tyr Asp Tyr
1               5                   10                  15

Glu Phe Trp Lys Asp Ser Gly Gly Ser Gly Thr Met Ile Leu Asn His
            20                  25                  30

Gly Gly Thr Phe Ser Ala Gln Trp Asn Asn Val Asn Asn Ile Leu Phe
        35                  40                  45

Arg Lys Gly Lys Lys Phe Asn Glu Thr Gln Thr His Gln Gln Val Gly
    50                  55                  60

Asn Met Ser Ile Asn Tyr Gly Ala Asn Phe Gln Pro Asn Gly Asn Ala
65                  70                  75                  80

Tyr Leu Cys Val Tyr Gly Trp Thr Val Asp Pro Leu Val Glu Tyr Tyr
                85                  90                  95

Ile Val Asp Ser Trp Gly Asn Trp Arg Pro Pro Gly Ala Thr Pro Lys
            100                 105                 110

Gly Thr Ile Thr Val Asp Gly Gly Thr Tyr Asp Ile Tyr Glu Thr Leu
        115                 120                 125

Arg Val Asn Gln Pro Ser Ile Lys Gly Ile Ala Thr Phe Lys Gln Tyr
    130                 135                 140

Trp Ser Val Arg Arg Ser Lys Arg Thr Ser Gly Thr Ile Ser Val Ser
145                 150                 155                 160

Asn His Phe Arg Ala Trp Glu Asn Leu Gly Met Asn Met Gly Lys Met
                165                 170                 175

Tyr Glu Val Ala Leu Thr Val Glu Gly Tyr Gln Ser Ser Gly Ser Ala
            180                 185                 190

Asn Val Tyr Ser Asn Thr Leu Arg Ile Asn Gly Asn Pro Leu Ser Thr
        195                 200                 205

Ile Ser Asn Asp Lys Ser Ile Thr Leu Asp Lys Asn Asn
    210                 215                 220
```

The invention claimed is:

1. A method for reducing the content of hexenuronic acids and/or improving the brightness of a cellulosic pulp, comprising contacting the cellulosic pulp with a haloperoxidase, a xylanase, hydrogen peroxide, and one or more ions selected from chloride, bromide, iodide, and thiocyanate, under suitable conditions whereby the content of hexenuronic acids in the cellulosic pulp is reduced by at least about 10%, wherein the haloperoxidase has an amino acid sequence that is at least 90% identical to SEQ ID NO: 1, wherein the xylanase has an amino acid sequence that is at least 90% identical to SEQ ID NO: 3.

2. The method of claim 1, further comprising contacting the cellulosic pulp with one or more tertiary amines.

3. The method of claim 1, wherein the haloperoxidase is a chloroperoxidase from enzyme class EC 1.11.1.10.

4. The method of claim 1, wherein the haloperoxidase is a vanadium haloperoxidase.

5. The method of claim 1, wherein the haloperoxidase has an amino acid sequence that is at least 95% identical to SEQ ID NO: 1.

6. The method of claim 1, wherein the xylanase has an amino acid sequence that is at least 95% identical to SEQ ID: 3.

7. The method of claim 1, wherein the xylanase is an endo-1,4-beta-xylanase from enzyme class EC 3.2.1.8.

8. The method of claim 1, wherein the xylanase has an amino acid sequence that is at least 97% identical to SEQ ID NO: 3.

9. A method for reducing the content of hexenuronic acids and/or improving the brightness of a cellulosic pulp, comprising containing the cellulosic pulp with a haloperoxidase, a xylanase, hydrogen peroxide, and one or more ions selected from chloride, bromide, iodide, and thiocyanate, under suitable conditions whereby the content of hexenuronic acids in the cellulosic pulp is reduced by at least about 10%, wherein the amino acid sequence of the haloperoxidase has at least 95% identity to SEQ ID NO: 1 and the amino acid sequence of the xylanase has at least 95% identity to SEQ ID NO: 3.

10. The method of claim 1, wherein the cellulosic pulp is a pulp made by alkaline cooking.

11. The method of claim 10, wherein the cellulosic pulp is a kraft pulp or a sulfite pulp.

12. The method of claim 1, further comprising an alkaline extraction stage.

13. The method of claim 12, wherein the alkaline extraction stage is reinforced with hydrogen peroxide and/or oxygen with or without a previous bleaching agent.

14. A method for reducing the content of hexenuronic acids of a cellulosic pulp, comprising contacting the cellulosic pulp with a haloperoxidase, a xylanase, hydrogen peroxide, and one or more ions selected from chloride, bromide, iodide, and thiocyanate, under suitable conditions whereby the content of hexenuronic acids in the cellulosic pulp is reduced by at least about 10%, wherein the haloperoxidase has an amino acid sequence that is 100% identical to SEQ ID NO: 1, wherein the xylanase has an amino acid sequence that is 100% identical to SEQ ID NO: 3.

15. The method of claim 1, wherein the haloperoxidase has an acid sequence that is at least 97% identical to SEQ ID NO: 1.

* * * * *